US005285037A

United States Patent [19]

Baranski et al.

[11] Patent Number: 5,285,037

[45] Date of Patent: Feb. 8, 1994

[54] ILLUMINATED DOME SWITCH

[75] Inventors: Antoni S. Baranski, San Carlos; David N. Larkins, Fremont, both of Calif.; Thomas J. Heath, Fort Collins; David W. Thompson, Loveland, both of Colo.

[73] Assignees: Ampex Systems Corp., Redwood City, Calif.; Data Entry Products, Inc., Loveland, Colo.

[21] Appl. No.: 866,694

[22] Filed: Apr. 10, 1992

[51] Int. Cl.[5] ..... H01H 9/16

[52] U.S. Cl. ..... 200/314

[58] Field of Search ..... 200/314

[56] References Cited

U.S. PATENT DOCUMENTS

| | | | |
|---|---|---|---|
| 4,056,701 | 11/1977 | Weber | 200/314 |
| 4,245,138 | 1/1981 | Harper | 200/513 X |
| 4,376,879 | 3/1983 | Nagata et al. | 200/314 |
| 4,423,294 | 12/1983 | Walser et al. | 200/513 X |
| 4,531,034 | 7/1985 | Inaba | 200/314 |
| 4,710,597 | 12/1987 | Loheac | 200/314 X |
| 4,772,769 | 9/1988 | Shumate | 200/314 |
| 4,885,443 | 12/1989 | Simcoe et al. | 200/314 X |
| 5,081,329 | 1/1992 | Mitusinski et al. | 200/314 |

*Primary Examiner*—Renee S. Luebke

*Attorney, Agent, or Firm*—Stephen Shear; Richard C. Liu

[57] ABSTRACT

An illuminated dome type switch for use on a control panel having a support base and suitable circuitry for interconnecting various components making up the panel is disclosed herein. This switch includes a light source and a dome, both of which are supported on the base of the panel and the latter of which is resiliently movable between a biased OFF position and a depressed ON position. The switch also includes a keycap having an upper portion through which at least some light can pass, and a bottom outer periphery including a dome actuator. The keycap is supported directly over the light source and to one side of the dome for movement between a biased OFF position so as not to depress the dome and a depressed ON position for causing the actuator to depress the dome in order to move the latter to its on position, whereby to turn on the light source by means of circuitry forming part of the control panel and a suitable source of power and thereby illuminate the upper portion of the keycap. In the embodiments disclosed herein, the bottom outer periphery of the keycap also includes one or more fulcrums to aid the actuator in depressing the dome.

13 Claims, 3 Drawing Sheets

ILLUMINATED DOME SWITCH

BACKGROUND OF THE INVENTION

1. Field of The Invention

The present invention relates generally to dome type switches for use on, for example, a control panel forming part of a video or data recorder or other such apparatus, and more particularly to a specifically designed illuminated dome type switch.

2. Description of the Related Art

Dome type switches, or merely dome switches as they will be referred to herein, are well known in the art. Even illuminated dome switches are known in the art. One such commercially available arrangement is illustrated in prior art FIG. 1. This arrangement which is generally indicated by the reference numeral 10 is shown including two dome switches 12 supported on a printed circuit board 14 with an incandescent lamp, light emitting diode or like light source 16 within a diffuser block 17 located between the two switches for simultaneously illuminating both. Each of the dome switches 12 includes a dome 18 and a keycap 20. The dome, which is shown mounted on the top surface of printed circuit board 14, is constructed of stainless steel or like electrically conductive, resilient material and is designed to resiliently move between a biased OFF or open position and a depressed ON or closed position, both of which are illustrated in FIG. 1.

Each of the keycaps 20 includes an upper main body 22 constructed of transparent or at least translucent material and a downwardly projecting actuator 24 disposed centrally below its associated main body portion 22. As illustrated in FIG. 1, each keycap is positioned immediately above a cooperating dome 18 within a cooperating opening 26 defined by an outer facia 28 forming part of the overall control panel 10. Means not shown, for example, a resilient boot, is disposed within each of the openings 26 in order to support its associated keycap for movement, between a biased raised position such that the keycaps actuator 24 does not depress dome 18 and a depressed lower position which, in turn, causes its actuator to depress the underlying dome.

Depression of a dome 18, as illustrated by the dome on the right in FIG. 1, closes a cooperating circuit on the PC board. Typically, the dome need be depressed only momentarily in order to close the circuit after which the circuit can again be opened by subsequently momentarily depressing the same keycap.

In the case of prior art dome type switches generally, it is very difficult to adequately and uniform illuminate individual keycaps. This is because the keycaps are typically disposed directly over their respective domes, as illustrated in FIG. 1. Thus, an attempt to illuminate a keycap typically takes the form of an incandescent lamp, LED or like light source located to one side of the switch, as shown. As will be described in more detail hereinafter, the present invention overcomes the problem just described by supporting a dome and a light source side by side, as in the case of the arrangement illustrated in FIG. 1. However, in accordance with the present invention, as will be seen, the keycap is disposed directly over the light source rather than over the dome, the latter being positioned to one side of the keycap. Nevertheless, the keycap is specifically designed to actuate its dome in the same reliable manner as the prior art. However, by placing the light source directly under the keycap, rather than to one side, it more efficiently and uniformly lights up the keycap.

BRIEF DESCRIPTION OF THE DRAWINGS

The present invention will be described in more detail hereinafter in conjunction with the drawings, wherein.

DETAILED DESCRIPTION OF THE PREFERRED EMBODIMENT

Figure 1:
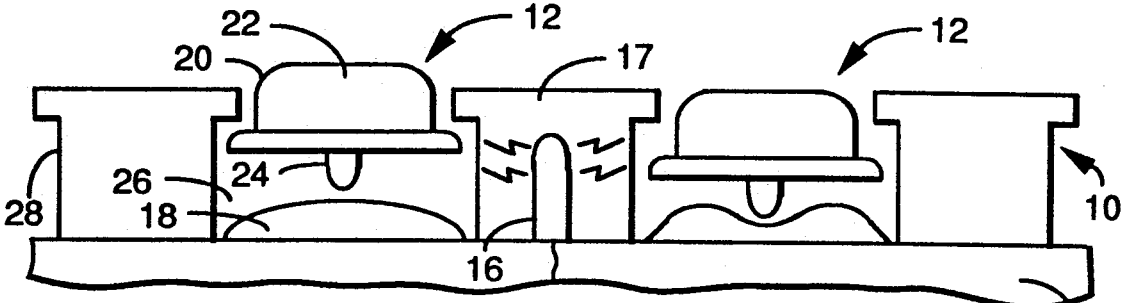
FIG. 1 (PRIOR ART)
FIG. 1 is a diagrammatic illustration of a control panel including an illumination dome switch arrangement designed in accordance with the prior art.
Figure 2:
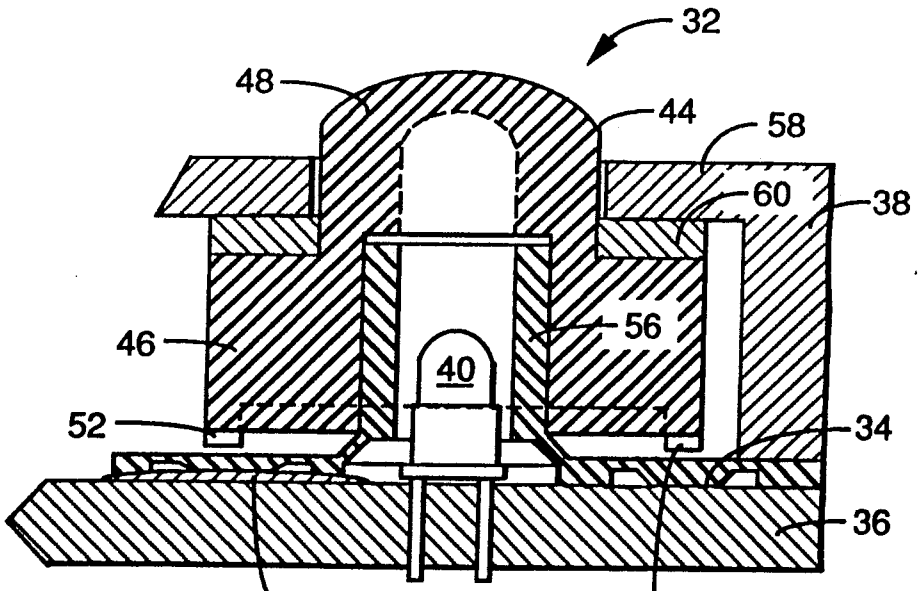
FIG. 2 is a diagrammatic illustration, at least partially in section, of a portion of a control panel including an illuminated dome switch arrangement designed in accordance with the present invention.
Figure 4:
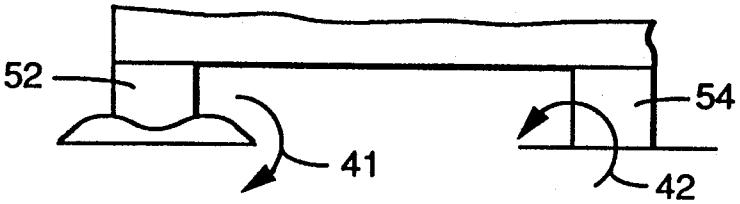
FIG. 4 diagrammatically illustrates an operating feature of the dome switch of FIG. 3.
Figure 3:
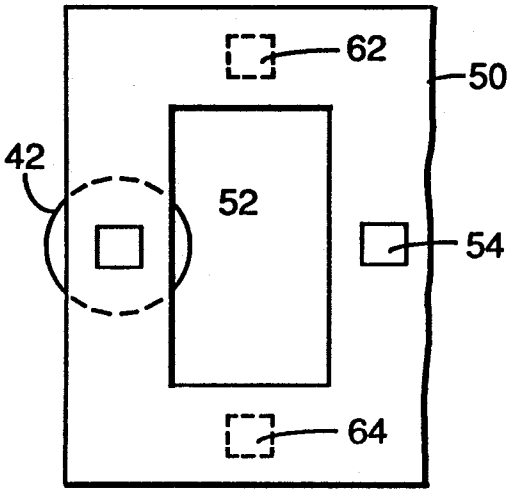
FIG. 3 is a plan view of the underside of a keycap forming part of the illuminated dome switch illustrated in FIG. 3.

Having already discussed prior art FIG. 1, attention is immediately directed to FIGS. 2, 3 and 4. FIG. 2, in particular, illustrates an illuminated dome switch which is designed in accordance with the present invention and which is generally indicated by the reference numeral 32. This switch is shown supported on the base 34 of a printed circuit board 36 which, like all printed circuit boards, includes suitable circuitry for interconnecting its various components. This circuit board is shown forming part of an overall control panel 38 which, itself, may be part of an overall data or video recorder or other such apparatus.

Illuminated dome switch 32 is shown in FIG. 2 including a light source 40 supported on base 34 of printed circuit board 36 and suitably connected in circuit with the latter. Light source 40 can be an incandescent lamp, an LED, or the like. Immediately to one side of light source 40 is a dome 42 which corresponds functionally to dome 18 described in conjunction with FIG. 1. Dome 42 is also supported on the base 34 of printed circuit board 36 and, like light source 40, it is suitably connected in circuit with the PC board. Like the light source, dome 42 forms part of overall dome switch 32.

Still referring to FIG. 2, dome switch 32 also includes a keycap 44 defined primarily by a hollow main body 46 having an uppermost finger depressing portion 48. The entire keycap is preferably constructed of a relatively rigid plastic material and at least its upper portion 48 is either light transparent or at least light translucent. For reasons to become apparent hereinafter, the main body 46 of keycap 44 includes a downwardly facing outermost periphery 50 (see FIG. 3) from which depend two rigid or relatively rigid leg members 52 and 54. These leg members 52 and 54, which are preferably integrally formed as part of the overall keycap, serve as a dome actuator and fulcrum, respectively, in accordance with the present invention, as will be explained.

Keycap 44 is shown positioned directly over light source 40 so that its leg member 52 rests immediately above the center of dome 42 while leg member 54 resides on the opposite side of the light source directly over base 34 of pc board 36. A resilient boot 56 constructed of, for example, rubber and consisting of a number of different interconnecting sections, is disposed between the light source 40 and keycap body 46, between the underside of leg member 52 and the top surface of dome 42, and, finally, between the underside of leg member 54 and the base 34 of pc board 36. Boot 56 supports the keycap 44 for movement between a biased raised position, as shown in FIG. 2, and a depressed position, which will be described hereinafter. The keycap is contained within a panel facia 58 with a suitable resilient gasket 60 positioned therebetween.

In operation, so long as keycap 44 remains undepressed, boot 56 supports it in the undepressed position illustrated in FIG. 2. In this position, the undersides of leg members 52 and 54 just barely engage the top sides of the underlying boot sections shown in FIG. 2. Upon depressing the keycap downward from its top side, the two leg members 52 and 54 are caused to move downward against their underlying boot sections, causing the latter to deform, thereby depressing dome 42 and ultimately closing its circuit in the manner described previously in conjunction with FIG. 1.

The actual interaction between leg members 52 and 54 is illustrated in FIG. 4, although in a somewhat exaggerated manner and with the boot 56 omitted for purposes of clarity. It should be noted first that dome 42 extends up from base 34. Thus, as keycap 44 is first depressed, leg member or actuator 52 engages the top of the dome before leg member or fulcrum 54 reaches base 34. This causes the actuator to initially pivot in the manner indicated by arrow A1. Eventually, leg member 54 reaches base 34 and then serves as a fulcrum. Specifically leg member 52, in order to depress the dome, actually must move downward further than the leg member 54, although this is not perceptible by the naked eye. In order for this to happen, once leg member 52 reaches the top of dome 42, leg member 54 is made to serve as a fulcrum pivoting in the manner indicated by arrow A2. In this way leg member 52 serves as an actuator against dome 42 in the same manner as previously described actuator 24. Indeed, because of this relationship between fulcrum 54 and actuator 52, actuation of dome 42 has been found to be just as reliable as actuation of dome 18 even though dome 42 is located to one side of keycap 44 rather than directly under it, as in the case of dome 18 and keycap 22. Obviously the exact ways in which the actuator and fulcrum pivot will depend on where keycap 44 is depressed.

In the embodiment illustrated in FIGS. 2–4, keycap 44 has been described including an actuator 52 and one fulcrum 54. In a modified embodiment, as illustrated in FIG. 3 by dotted lines the keycap includes a pair of additional fulcrums 62 and 64 depending from the downwardly facing outer periphery 50 of the keycap, on opposite sides of the periphery between actuator 52 and fulcrum 54. These additional fulcrums help ensure that dome 42 will be appropriately actuated when the keycap is depressed. These additional keycaps are especially desirable where the keycap (including the actuator and fulcrums) are constructed of silicone, rubber or like resilient material, as will be described with FIG. 5. As a further modification, the boot sections between actuator 52 and dome 42 may be eliminated so that the actuator engages directly against the dome. In a similar manner, the boot section between fulcrum 54 and base 34 of pc board 36 may be eliminated so that the fulcrum can engage directly against the pc board.

Figure 5:
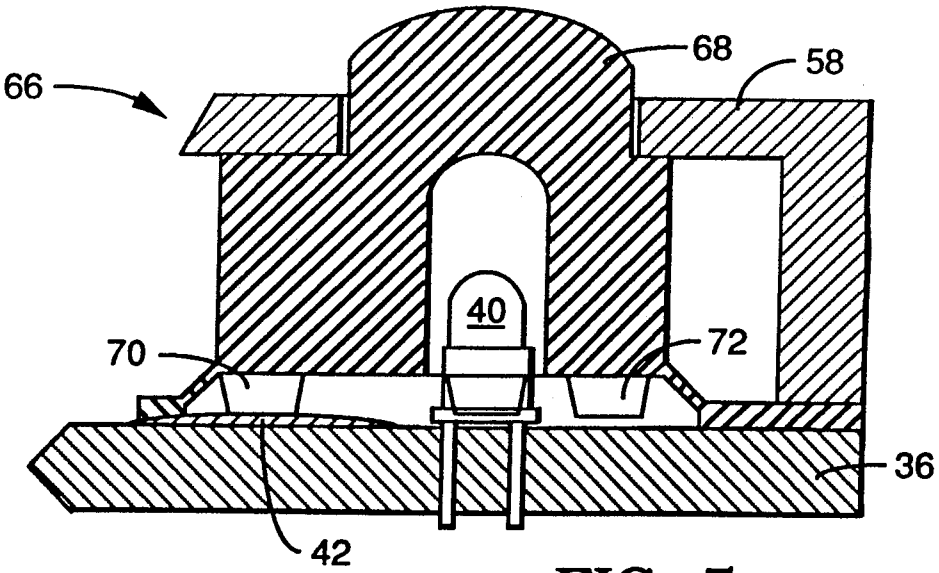
FIG. 5 is a diagrammatic view, at least partially in section, of an illuminated dome switch designed in accordance with a further embodiment of the present invention.

Turning to FIG. 5, a modified dome switch is illustrated. This switch, generally indicated by the reference numeral 66, may include the same pc board 36, light source 40, dome 42 and panel facia 58 as illustrated in FIG. 2. However, its keycap 68 is constructed of a semiresilient material, for example, silicone rubber, and an inner boot has been entirely eliminated. Rather, the keycap itself is sufficiently resilient to move between a biased non-actuating position and a depressed position but sufficiently rigid to actuate dome 42. In this regard, the keycap includes a downwardly depending actuator 70 resting directly on top of dome 42 and a downwardly depending fulcrum 72 (or three such fulcrums) resting against the top surface of printed circuit board 36. Other than the fact that keycap 68 is constructed of a resilient material and does not require an internal boot, it may be identical in design to keycap 44.

Figure 6:
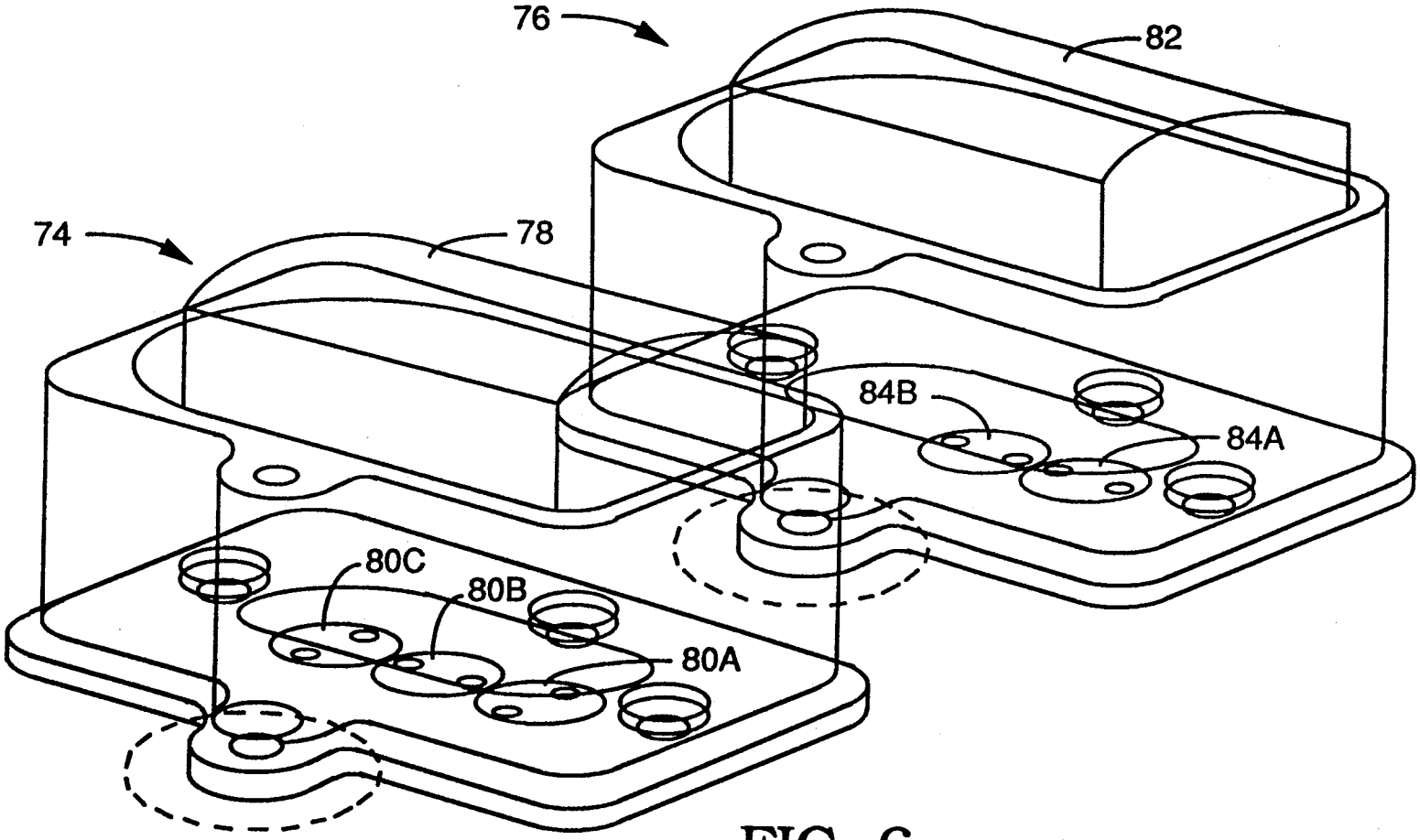
FIG. 6 is an exploded perspective view of illuminated dome switch arrangements designed in accordance with still further embodiments of the present invention.

Finally, turning to FIG. 6, two further modified dome switches 74 and 76 are shown. Dome switch 74 includes a keycap 78 containing three centrally located lights generally indicated at 80A, 80B and 80C. Dome switch 76 includes a keycap 82 containing two centrally located lights 84A and 84B. Both dome switches include domes to one side as in the other embodiments and similar actuators and fulcrums.

What is claimed is:

1. An illuminated dome switch, comprising:

(a) a light source;

(b) a dome located to one side of said light source, said dome being resiliently movable between a biased OFF position and a depressed ON position;

(c) means defining a base for supporting said light source and said dome; and (d) a keycap supported directly over said light source and to one side of said dome for movement between a biased OFF position so as not to depress said dome and a depressed ON position for depressing said dome in order to move the latter to its ON position, whereby to turn on said light source by means of suitable power supply means and circuitry, said keycap having an upper portion thereof which is located over said light source and through which at least some light passes from said light source when the latter is turned on, said keycap including a downwardly facing actuating member positioned on one edge of the keycap directly over said dome so as to directly engage the dome and thereby directly depress the latter when the keycap is in its depressed position, and a second downwardly facing member on an edge of the keycap opposite said actuating member, said second member directly engaging an underlying section of said base when the keycap is in its depressed position so as to serve as a fulcrum for said actuating member.

2. A dome switching switch according to claim 1 wherein said keycap includes a downwardly facing outer periphery and wherein said actuating member and said second member extend downwardly from said downwardly facing periphery.

3. A dome switch according to claim 2 wherein said keycap includes third and fourth members extending downward from said outer periphery at locations opposite one another and between said actuating member and said second member, said third and fourth members also serving as fulcrums for said actuating member.

4. A dome switch according to claim 2 including resilient boot means supporting said keycap for movement between its OFF and ON positions.

5. A dome switch according to claim 2 wherein said keycap itself is constructed of resilient material sufficient to allow it to move between its OFF and ON positions.

6. An illuminated dome switch, comprising:

(a) A light source;

(b) a dome located to one side of said light source, said dome being resiliently movable between a biased OFF position and a depressed ON position;

(c) means defining a base for supporting said light source and said dome;

(d) a keycap supported directly over said light source and to one side of said dome for movement between a biased OFF position so as not to depress said dome and a depressed ON position for depressing said dome in order to move the latter to its ON position; whereby to turn on said light source by means of suitable power supply means and circuitry, said keycap having an upper portion thereof which is located over said light source and through which at least some light passes from said light source when the latter is turned on, said keycap including a downwardly facing outer periphery, an actuating member positioned on one edge of and extending downwardly from the outer periphery of the keycap directly over said dome so as to depress the latter, at least indirectly if not directly, when the keycap is in its depressed position, and a second downwardly facing member on an edge of the periphery of the keycap opposite said actuating member, said second member engaging an underlying section of said base, either directly or indirectly, when the keycap is in its depressed position so as to serve as a fulcrum for said actuating member; and (e) resilient boot means supporting said keycap for movement between its OFF and ON positions, said boot means including segments thereof disposed directly under said actuating member and said second member, whereby said actuating and second members directly engage these segments when the keycap is in its depressed position and indirectly engage dome and base section.

7. An illuminated dome switch, comprising:

(a) a light source;

(b) a dome located to one side of said light source, said dome being resiliently movable between a biased OFF position and a depressed ON position;

(c) means defining a base for supporting said light source and said dome; and (d) a keycap supported directly over said light source and to one side of said dome for movement between a biased OFF position so as not to depress said dome and a depressed ON position for depressing said dome in order to move the latter to its ON position, whereby to turn on said light source by means of suitable power supply means and circuitry, said keycap having an upper portion thereof which is located over said light source and through which at least some light passes from said light source when the latter is turn on, said keycap including a downwardly facing actuating member positioned on one edge of the keycap directly over said dome so as to depress the latter, at least indirectly if not directly, when the keycap is in its depressed position, and a second downwardly facing member on an edge of the keycap opposite said actuating member, said second member engaging an underlying section of said base, either directly or indirectly, when the keycap is in its depressed position so as to serve as a fulcrum for said actuating member; and (e) said dome extending vertically upward from said base above said underlying base section such that during normal operation of said keycap, said actuating member first engages said dome without depressing it, causing the keycap to pivot, then said second member engages its underlying base section as a result of the pivoting movement of the keycap, thereby serving as a fulcrum to cause said actuating member to depress said dome.

8. A dome switch according to claim 7 wherein said actuating member and said second member respectively engage said dome and said base section directly.

9. A dome switch according to claim 7 wherein said keycap includes a downwardly facing outer periphery and wherein said actuating member and said second member extend downwardly from said downwardly facing periphery.

10. A dome switch according to claim 9 wherein said keycap includes third and fourth members extending downward from said outer periphery at locations opposite one another and between said actuating member and said second member, said third and fourth members also serving as fulcrums for said actuating member.

11. A dome switch according to claim 9 wherein said keycap itself is constructed of resilient material sufficient to allow it to move between its OFF and ON positions.

12. A dome switch according to claim 9 including resilient boot means supporting said keycap for movement between its OFF and ON positions.

13. A dome switch according to claim 12 wherein said boot means includes segments thereof disposed directly under said actuating member and said second member, whereby said actuating and record means directly engage these segments when the keycap is in its depressed position and indirectly engage said dome and base section.

* * * * *